United States Patent [19]

Valentine

[11] Patent Number: 4,819,591

[45] Date of Patent: Apr. 11, 1989

[54] POPPET VALVE ASSEMBLIES

[75] Inventor: Ronald E. Valentine, Wittersham, United Kingdom

[73] Assignee: Collins Motor Corporation Limited, Perth, Australia

[21] Appl. No.: 135,160

[22] PCT Filed: Mar. 6, 1987

[86] PCT No.: PCT/GB87/00159

§ 371 Date: Dec. 17, 1987

§ 102(e) Date: Dec. 17, 1987

[87] PCT Pub. No.: WO87/05356

PCT Pub. Date: Sep. 11, 1987

[30] Foreign Application Priority Data

Mar. 7, 1986 [GB] United Kingdom ..... 8605619

[51] Int. Cl.[4] ..... F01L 1/26

[52] U.S. Cl. ..... 123/90.44; 123/90.27; 123/90.22; 123/90.16; 123/90.23; 123/90.4

[58] Field of Search ..... 123/90.27, 90.22, 90.44, 123/90.1, 90.16, 90.4

[56] References Cited

U.S. PATENT DOCUMENTS

| | | | |
|---|---|---|---|
| 4,624,222 | 11/1986 | Yoshikawa | 123/90.27 |
| 4,637,350 | 1/1987 | Kuroda | 123/90.27 |
| 4,638,774 | 1/1987 | Aoi | 123/90.27 |
| 4,638,779 | 3/1985 | Kitada | 123/385 |
| 4,660,529 | 4/1982 | Yoshikawa | 123/432 |
| 4,679,532 | 7/1987 | Aoi et al. | 123/90.27 |
| 4,697,554 | 10/1987 | Bothwell | 123/90.27 |

FOREIGN PATENT DOCUMENTS

| | | | |
|---|---|---|---|
| 453876 | 6/1913 | France | 123/90.27 |
| 113512A | of 1983 | Japan | 123/90.27 |
| 1813A | of 1986 | Japan | 123/90.27 |
| 1128266 | 9/1968 | United Kingdom | 123/90.27 |

OTHER PUBLICATIONS

"Nur Ventile im Kopf", Motorrad, Nov. 1980, pp. 154–156.

*Primary Examiner*—Raymond A. Nelli

*Attorney, Agent, or Firm*—Flynn, Thiel, Boutell & Tanis

[57] ABSTRACT

According to the present invention there is provided a poppet valve assembly comprising a plurality of simultaneously operated poppet valve members slidably mounted for movement between their open and closed positions by their stems the axes of which are not all parallel, a rocker mounted for rocking movement about a rocking axis transverse to each valve stem axis, the rocker having a valve stem engaging tappet element for each valve for engaging an end face of the respective valve stem, the respective lengths of the valve stems, being such that the tappet elements are not all in the same plane through the rocker axis in such a manner that simultaneously for each valve, in an intermediate part of the valve lift travel, a line from the rocker axis to the point of engagement of the tappet element with the end face of the valve stem is perpendicular to the valve stem axis.

14 Claims, 6 Drawing Sheets

POPPET VALVE ASSEMBLIES

The present invention relates to a poppet valve assembly, for example for a piston-and-cylinder internal combustion engine, in which a plurality of poppet valves are required to be operated simultaneously.

There is now increasing interest in using more than one inlet valve, and sometimes more than one exhaust valve, per cylinder to increase the effective port window area during induction or exhaust of a charge of air or mixture, to a value greater than that available with the largest single poppet valve which can be accommodated in the required combustion chamber design.

According to the present invention there is provided a poppet valve assembly comprising a plurality of simultaneously operated poppet valve members slidably mounted for movement between their open and closed positions by their stems the axes of which are not all parallel, a rocker mounted for rocking movement about a rocking axis transverse to each valve stem axis, the rocker having a valve stem engaging tappet element for each valve for engaging an end face of the respective valve stem, the respective lengths of the valve stems, being such that the tapper elements are not all in the same plane through the rocker axis in such a manner that simultaneously for each valve, in an intermediate part of the valve lift travel, a line from the rocker axis to the point of engagement of the tappet element with the end face of the valve stem is perpendicular to the valve stem axis.

Also, according to the invention, there is provided a poppet valve assembly comprising a plurality of simultaneously operated poppet valve members slidably mounted for movement between their open and closed positions by their stems, the axes of which are not all parallel, a rocker mounted for rocking movement about a rocking axis transverse to each said valve stem, the rocker carrying a valve stem engaging tappet element for each valve member for engaging an end face of the respective valve stem, wherein the angular spacing of the valve stem engaging tappet elements around the rocker axis corresponds to the angles between the axes of the respective valve stems and the lengths of the valve stems are such that the tappet elements of the rocker engage the valve stems simultaneously.

The motions of the tappet elements relative to their respective valve stems are then identical and can thus be simultaneously optimised.

To obtain equal valve lift, the valve stem axes are made equidistant from the rocker axis.

If a greater lift is required for one valve than another, this is achieved by spacing the axis of the said one valve a proportionately greater distance from the rocker axis than the other valve.

Figure 1:
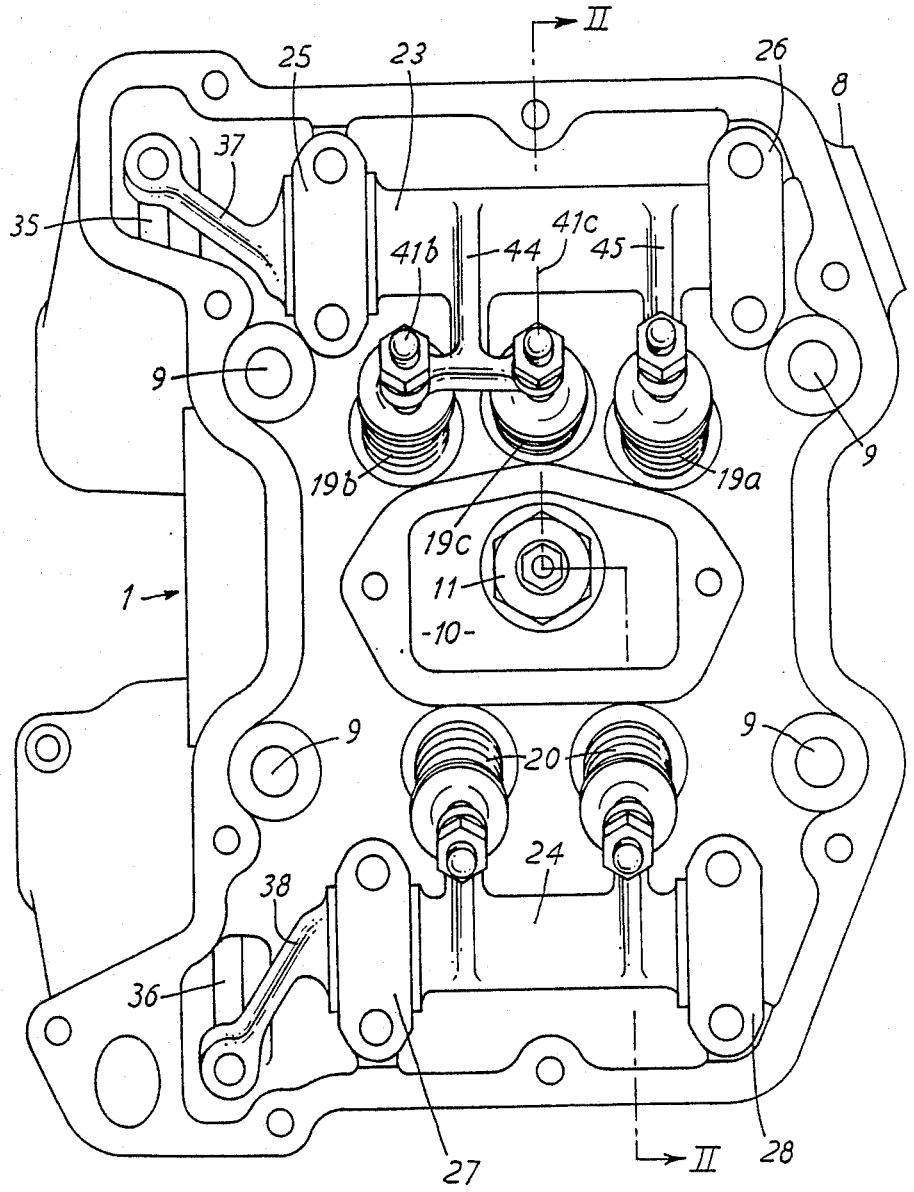
Figure 2:
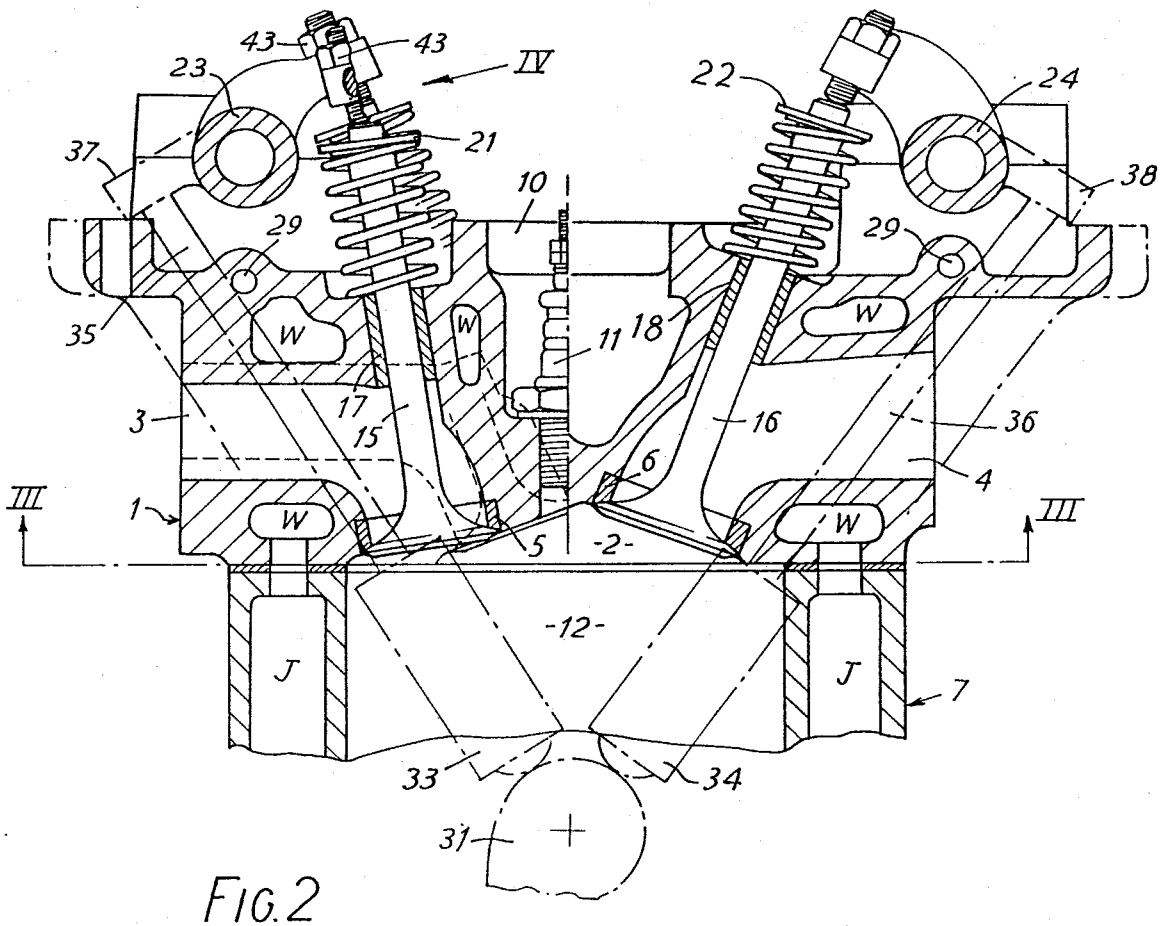
Figure 3:
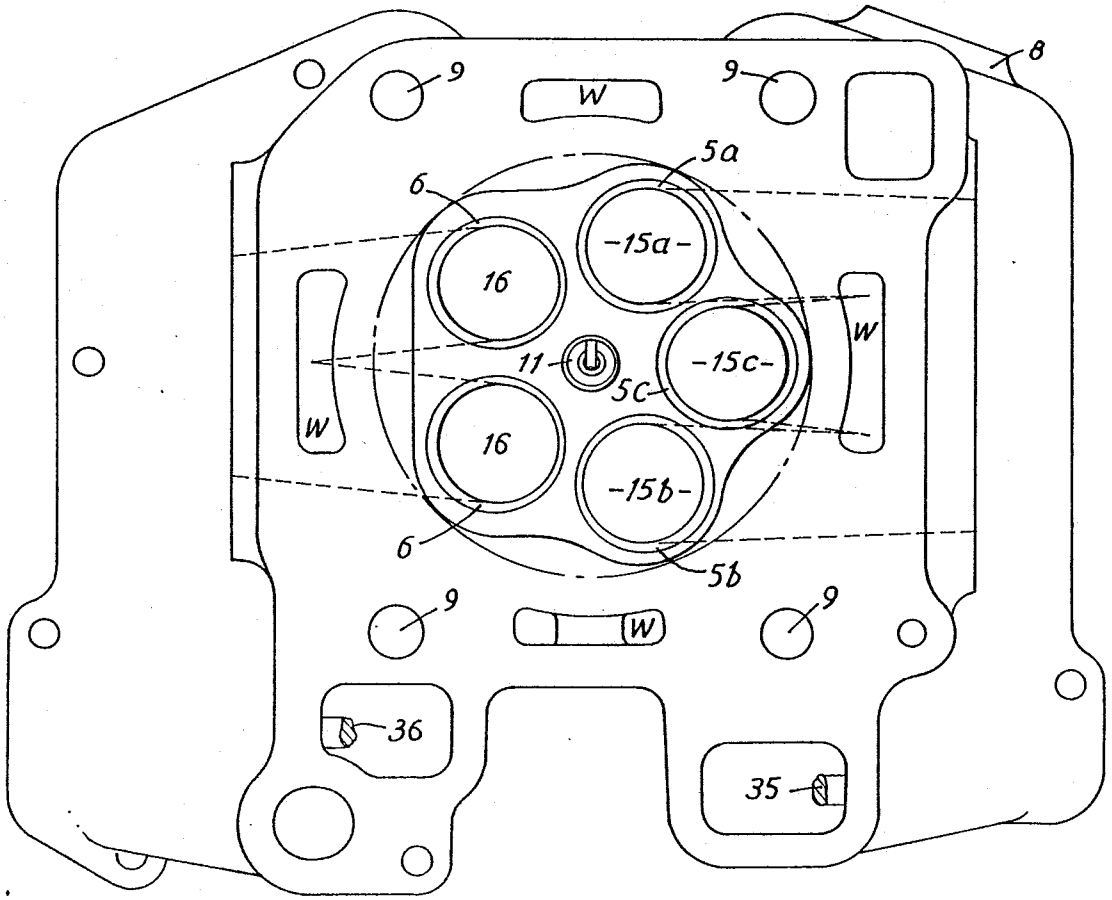
Figure 5:
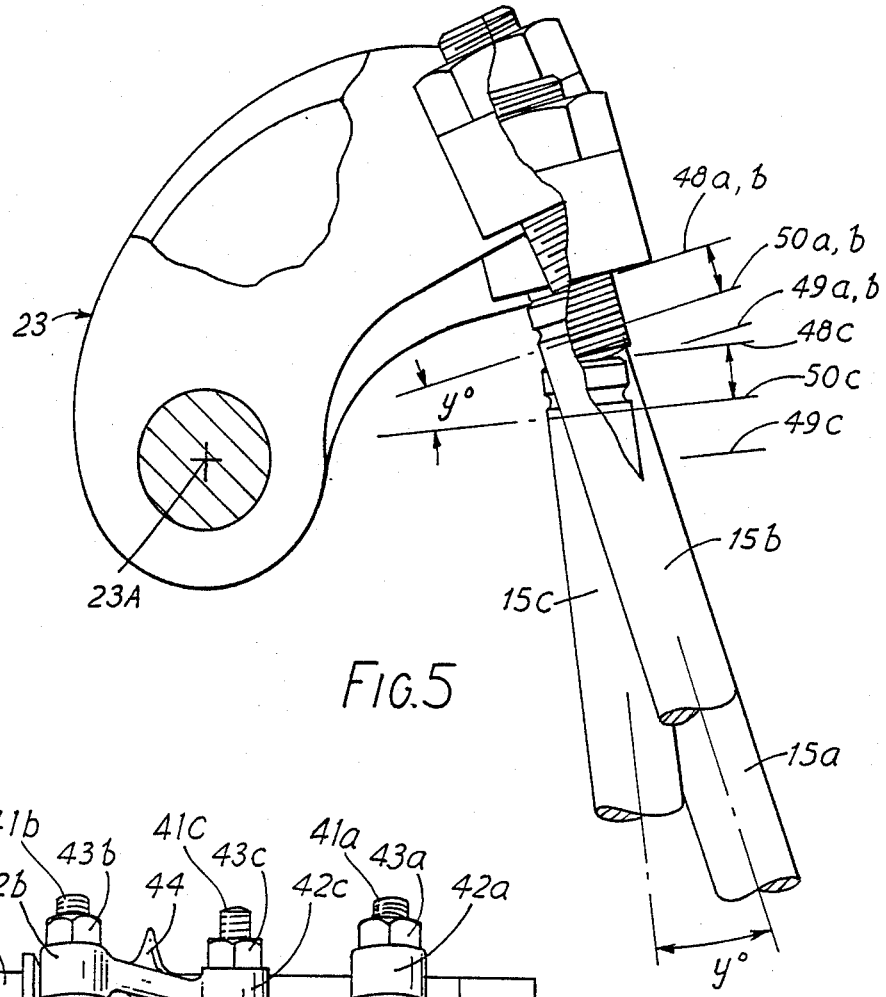
Figure 4:
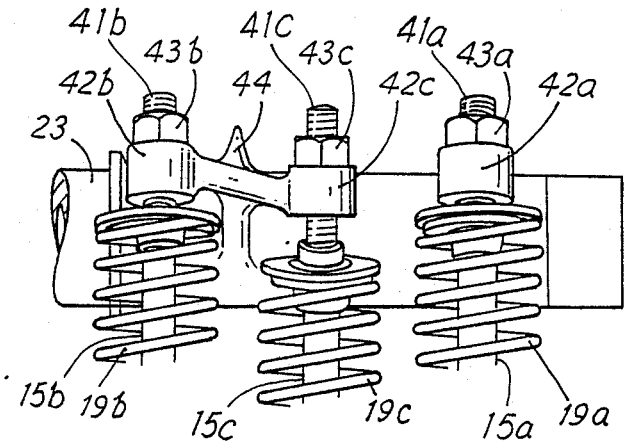
Figure 6:
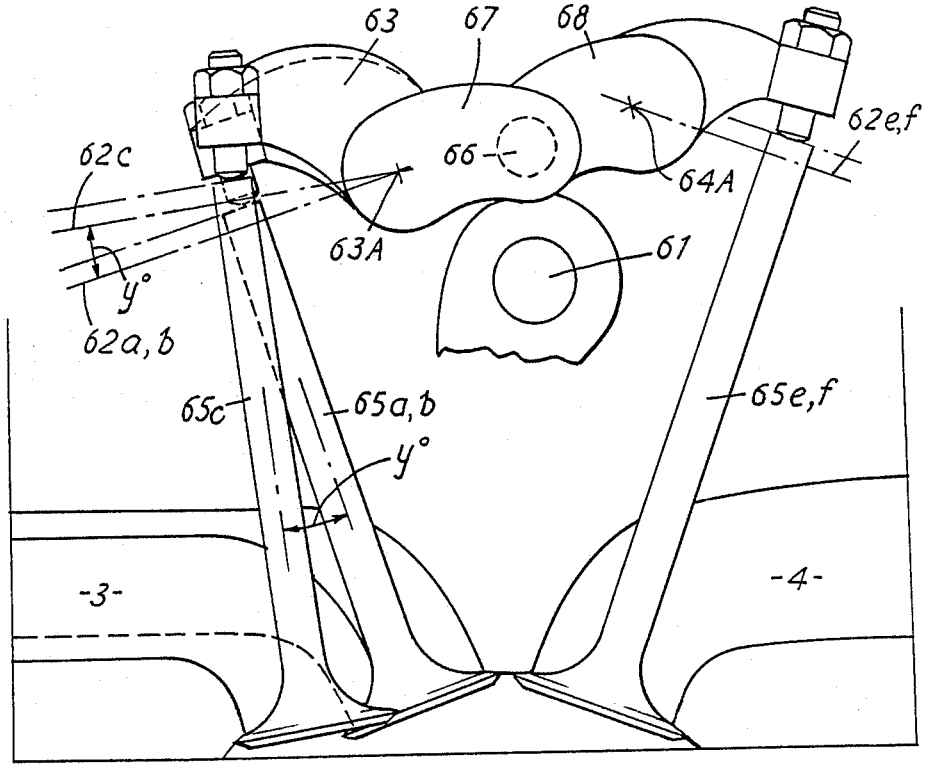
Figure 7:
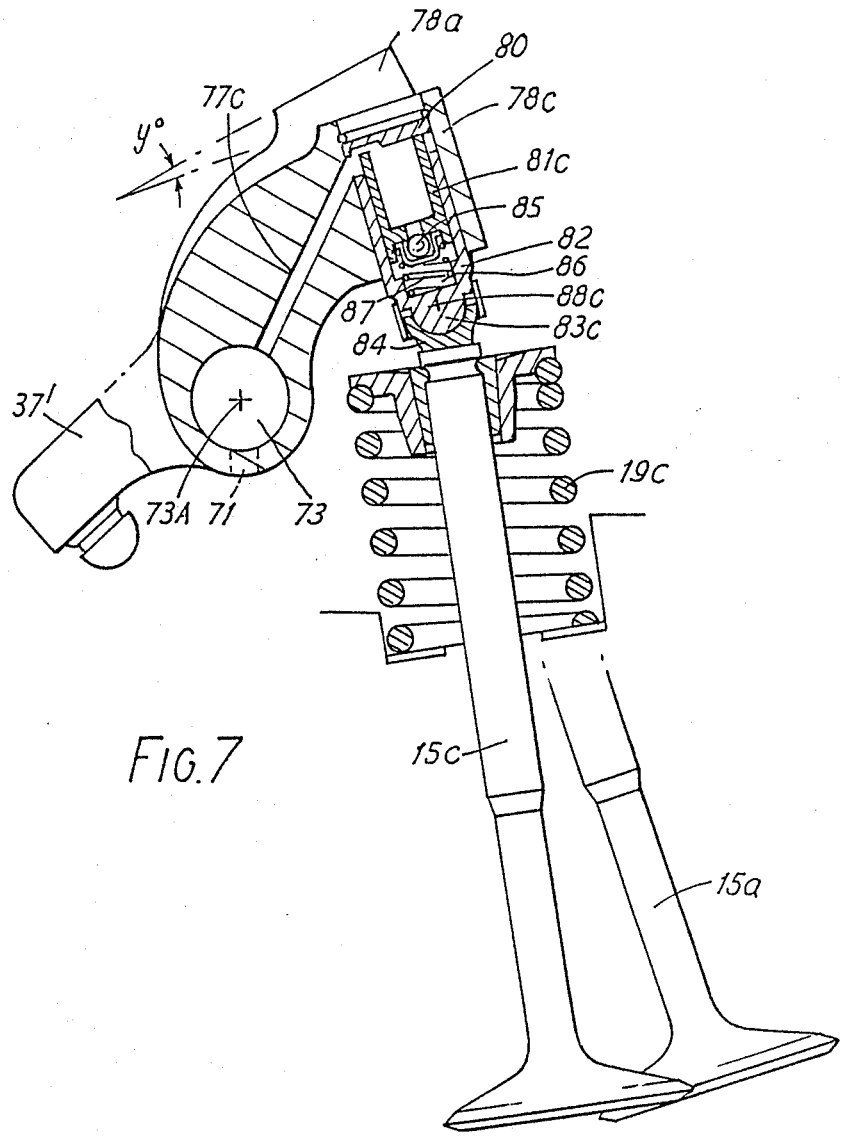
Figure 8:
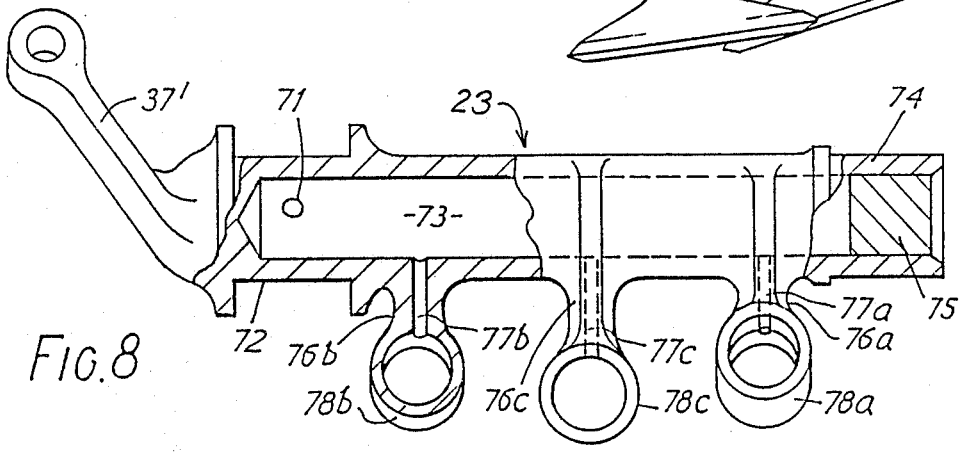

The invention will now be further described by way of example with reference to the accompanying drawings, in which:

FIG. 1 is a top elevational view of the cylinder head of a single-cylinder internal combustion engine (or of one cylinder of a radial internal combustion engine), FIG. 2 is a longitudinal section on the line II—II of FIG. 1, FIG. 3 is a underplan view of the cylinder head as seem in the direction of the arrows III—III of FIG. 2, FIG. 4 is a view of the inlet rocker shaft in the direction of the arrow IV of FIG. 2, FIG. 5 shows a detail of FIG. 2 on an enlarged scale, FIG. 6 shows diagramatically the valve layout in a cylinder head incorporating an overhead camshaft, FIG. 7 is a view corresponding to portions of FIG. 2 with a modified valve gear incorporating hydraulic self-adjusting tappets and FIG. 8 is a plan view of the rocker shaft of FIG. 7.

The cylinder head 1 shown in FIGS. 1 to 3 is formed by an aluminium alloy casting. The casting defines a combustion chamber 2 and inlet and exhaust ducts 3 and 4 which communicate with the combustion chamber 2 through inlet and exhaust ports defined by inlet and exhaust valve seat inserts 5 and 6 respectively.

The cylinder head casting 1 also defines coolant passages W which receive water-based coolant from a coolant jacket J (FIG. 2) in a cylinder block 7 to which the head is secured and convey the coolant to an outlet 8 (FIGS. 1 and 3) in a top surface of the cylinder head.

Also formed in the cylinder head are four holes 9 through which pass studs for holding the head down onto the cylinder block 7 and a central well 10 accommodating a spark plug 11 secured in a screw threaded bore extending from the well 10 to the combustion chamber 2 on the axis of the bore 12 in the cylinder block 7. A rocker cover (not shown) formed with a central opening to form the upper part of the well 10 is secured over the upper part of the cylinder head to enclose the valve and rocker mechanism.

To obtain the maximum effective inlet port 'window' area during an induction stroke, there are three inlet ports 5*a*, 5*b* and 5*c*. Adequate exhaust port window area is achieved with two exhaust ports 6*a* and 6*b*.

Each of the ports 5 and 6 forms a valve seat for a respective inlet or exhaust poppet valve member 15, 16 respectively. The valve members 15 and 16 are of the normal poppet construction with their valve stems slidable in valve guide inserts 17 and 18 in bores formed in the cylinder head casting coaxially with the respective valve seat inserts 5,6. The valve members 15 and 16 are biassed to their closed position, in which their heads make sealing contact with their respective seats 5 and 6, by valve springs 19 and 20 which bear at one end against the upper surface of the cylinder head and at their upper end against washers 21 and 22 which each in turn bear against a split coller (not shown) engaged in a groove near the end of the respective valve stem.

The valves are pushed to their open position as required during each operating cycle of the engine by rockers 23 and 24 which are mounted for rocking movement on pedestal portions 25, 26, 27 and 28 of the cylinder head casting 1, oil being supplied from the lubricating system (not shown) of the engine to the bearings for the rockers through passages 29 formed in the cylinder head and pedestals. Each rocker 23,24 is rocked about its axis when its associated valves are to be operated by a respective cam on a camshaft 31 driven at half engine speed. Roller-type cam followers 33 and 34 cooperate with the respective cams and transmit their motion through push rods 35 and 36 to operate lever portions 37 and 38 of the rockers 23 and 24. In turn, the rockers transmit the motion to the valve stems by way of adjustable tappet screws 41 engaged in screw threaded eyes 42 formed integrally with the rockers 23 and 24, the tappet screws 41 being secured after adjustment by means of lock nuts 43.

It is readily apparent from FIG. 3 that the heads of the three inlet valve members 15*a*, 15*b* and 15*c* cannot all be arranged in a straight line without greatly reducing their diameters and thereby reducing the port window area when the valves are opened. Accordingly, they must be arranged in a triangular formation. The ports 5*a* and 5*b* and their valves 15*a* and 15*b* have their axes coplanar. To enable all three inlet valves 15 to be operated by the same rocker 23, and to ensure that the 'lift' i.e. the distance through which the valves move between their open and closed positions, is the same or similar for each of the three valves, the axes of the three valve members must all pass the axis of the rocker at the same or similar distances. The axis of the valve 15*c* is accordingly inclined to the plane through the axis of the valves 15*a* and 15*b* at an angle y of about 10°.

To avoid excessive side loads between the valve stems and their guides at all positions between their closed and open positions (with consequent wear) and thus also to avoid excessive loads on the rocker bearings, it has been found that it is desirable that the point of contact of a tappet screw and the end face of its respective valve stem be in a plane through the rocker axis that is perpendicular to the axis of the valve stem at some point during the valve stem travel between the valve open and closed positions.

As can be seen from FIGS. 2, 4 and 5, the point of contact of the tappet screw 41*c* with the valve stem 15*c* is angularly spaced from the corresponding points of contact between the tappet screws 41*a* and 41*b* and their respective valves about the axis 23A of the rocker 23 by the same angle y. To achieve this, the stem of the valve 15*c* must be longer than the stems of the valve 15*a* and 15*b* if the heads of all three valves are to form parts, approximately, of the same wall of the combustion chamber 2.

In the construction shown in FIGS. 1 and 4, the screw threaded eyes 42*b* and 42*c* are carried on same arm 44 of the rocker 23, while the tappet eye 42*a* is carried by a separate arm 45.

At some point in the travels of the tappets from the closed position 48 to the fully open position 49 of the valves, a plane 50 through the rocker axis 23A and the point of contact of a tappet screw and the end face of its respective valve stem is at right angles to the axis of the respective valve stem. Normally, this takes place at a point in the range of 30% to 50%, here 35%, of the full valve travel towards its open position. In the embodiment shown in the drawings, the planes 50*a* and 50*b* are of course coincident and are at the angle y to the plane 50*c*. In the position just described, the points of contact of the tappet screws with their respective valve stems are all at the same distance from the rocker axis 29*a*. It will accordingly be appreciated that the 'wiping' motion which takes place between the tappet screw and the end face of the valve stem is the same for all three of the inlet valves despite the fact that the valve members are positioned at different angles. Accordingly, no compromise is required in determining the rocker and tappet geometry so that the optimum wiping motion can be achieved for each of the three tappets while ensuring minimum side loads on the valve stems and rockers.

The two exhaust valve members are parallel and are thus of the same length so that the corresponding design of their tappet and rocker geometry presents no difficulties.

If a greater lift travel is required for one or more of the valves, e.g. for the valve 15*c*, than for the other valve or valves, the distance between the rocker axis and the axis of the respective valves is made proportional to the required lifts. The motions of the three tappets in relation to their valve stems and then geometrically similar and again no compromise is required in their design.

If a third exhaust valve is required, the resulting three exhaust valves and their operating rocker arms and tappets can be arranged in much the same way as described above for the inlet valves.

FIG. 6 is a simplified diagram similar to FIG. 2 showing the application of the invention to an overhead camshaft engine. In this case, the inlet and exhaust valves are operated by a single, overhead camshaft 61 (having inlet and exhaust cams). Again, an inlet rocker 63 and an exhaust rocker 64 operate respectively three inlet valve members 65*a*, 65*b* and 65*c* and two exhaust valve members 65*e* and 65*f*. The inlet and exhaust rockers 63 and 64 carry arms 67 and 68 on which are rotatably mounted cam follower rollers 66.

The axes 63A and 64A of the rockers 63 and 64 lie inboard of the axes of the inlet and exhaust valves. The axis of the inlet valve 65*c* is again inclined at angle y° to the common plane of the axes of the other inlet valves 65*a* and 65*b*. To obtain the same operating geometry for all three inlet valves and their respective tappets, the central inlet valve member 65*c* must have a longer stem than the other two inlet members 65*a* and 65*b*. The positions of the upper end faces of the various valve members are indicated in FIG. 6 by the reference numeral 62. In a partially opened position of the three inlet valves, the end faces of the valves 65*a* and 65*b* lie in a plane 62*a*, *b* while the upper end face of the valve member 65*c* lies in the plane 62*c* inclined to the plane 62*a*, *b* at the angle y. Correspondingly, the upper end faces of the exhaust valve 66 pass through a plane 62*e*, *f* through the rocker axis 64*a* during their opening movement.

FIGS. 7 and 8 show a modification to the valve gear shown in FIGS. 1 to 4 in which the manually adjustable screw type tappets are replaced by self-adjusting hydraulic tappets.

As shown in FIG. 8, the inlet rocker 23 has a radial drilling 71 in its journal portion 72 supported in the pedestal 25 to receive oil from a drilling in the latter which passes into the interior 73 of the shaft portion of the rocker. The journal portion 74 of the rocker which is supported in the pedestal 26 is closed by a plug 75. The rocker carries three separate tappet supporting arms 76*a*, 76*b* and 76*c* each of which is formed with a radially extending oil duct 77.

The outer, free end of each rocker arm 76 is formed as an eye 78 in which is housed a hydraulic self-adjusting tappet 80 of the kind available under the trade mark INA. This comprises a cylindrical oil reservoir 81 which is open at its upper end to receive oil from the passage 77*c*. A tappet sleeve 82 is slidable in the eye 78 and is a sliding fit around the exterior of the reservoir member 81. The lower end of the tappet sleeve 82 is closed by a portion 83 forming a ball portion of a ball and socket joint with the ball portion 83 engaged in a hemispherical seating in a tappet pad 84. Oil can pass through a non-return ball valve 85 from the reservoir into a chamber 86 formed between the lower end of the reservoir 81 and the interior of the tappet sleeve 82 so as to keep the chamber 86 full of oil. A spring 87 urges the tappet sleeve 82 downwards to bring the tappet pad 84 into contact with the upper end of the stem of the valve member 15.

In operation, clockwise movement (FIG. 7) of the rocker causes the reservoir member 81 to try to move down inside the tappet sleeve 82. The non-return valve 85, however, prevents oil from leaving the tappet chamber 86 so that the tappet sleeve 82 becomes effectively solid with the rocker and forces the tappet head 84 downwards to open the valve. To take up any clearance which may develop in the closed positions of the inlet valves, the spring 87 will cause oil to be drawn downwards from the reservoir through the ball valve 85.

As can be seen in FIG. 7, the tappet eye 78*c* is displaced relative to the tappet eye 78*a* and *b* by an angle y° with respect to the axis of the rocker and correspondingly the centre 88*c* of the ball portion 83*c* is displaced relative to the centres of the ball portions 83*a* and 83*b* by the angle y°. In a partially opened position (e.g. at 35% lift), for each valve, a line from the rocker axis 73A to the centre 88 of the ball portion 83 is perpendicular to the valve member axis.

The tappet pad 84 thus forms in effect an extension of the valve stem although the relative lateral 'wiping' motion takes place between the end face of the valve stem and the lower face of the tappet pad.

I claim:

1. A poppet valve assembly comprising a plurality of simultaneously-operated inlet poppet valve members cooperating with a single combustion chamber, said inlet poppet valve members having valve stems and being slidably mounted for reciprocating movement between their open and closed positions along axes passing through their valve stems, the axes of said valve stems not all being parallel with each other; a rocker mounted for rocking movement about a rocking axis transverse to each valve stem axis, the rocker having a tappet element for each inlet valve member for engaging an end face of the respective valve stem, the respective lengths of the valve stems being such that the points of engagement of the tappet elements with the end faces of the valve stems do not all lie in the same axial plane passing through the rocker axis and said valve stems being positioned such that for each inlet valve member, in an intermediate position of said reciprocating movement, a line from the rocker axis to the point of engagement of the tappet element with the end face of the valve stem is perpendicular to the respective valve stem axis.

2. A poppet valve assembly comprising a plurality of simultaneously operated inlet poppet valve members cooperating with a single combustion chamber, said poppet valve members having valve stems and being slidably mounted for reciprocating movement between their open and closed positions along axes passing through their valve stems, the axes of said valve stems not all being parallel with each other; a rocker mounted for rocking movement about a rocking axis transverse to each valve stem axis, the rocker having a tappet element for each valve member for engaging an end face of the respective valve stem, the angular spacing between axial planes passing through the rocker axis and the points of engagement of the tappet elements with the end faces of the respective valve stems corresponding to the angle between the axes of the respective valve stems, and the lengths of the valve stems being such that the tappet elements of the rocker engage the valve stems simultaneously.

3. A poppet valve assembly for a combustion chamber comprising a plurality of simultaneously operated inlet poppet valve members and a plurality of simultaneously operated outlet poppet valve members, each of said inlet and outlet poppet valve members having a valve stem and being slidably mounted for reciprocating movement between its open and closed positions along an axis passing longitudinally through its valve stem, the axes of the valve stems of said inlet poppet valve members not all being parallel with each other; an inlet valve rocker member mounted for rocking movement about a rocking axis transverse to the axes of the inlet poppet valve member stems, said inlet valve rocker member having a tappet element for each inlet poppet valve member for engaging an end face of the respective valve stem of said inlet poppet valve members, said valve stems of the inlet poppet valve members having respective lengths such that points of engagement of the tappet element with the end faces of the inlet poppet valve stems do not all lie in the same axial plane through the inlet valve rocker member axis and being positioned such that at an intermediate position during the reciprocating movement of said inlet poppet valve members, lines from the inlet valve rocker member axis to the point of engagement of the tappet elements with the end faces of the respective inlet poppet valve member stems simultaneously perpendicular to the axes of the valve stems of the respective inlet poppet valve members.

4. A poppet valve assembly for a combustion chamber comprising a plurality of simultaneously operated inlet poppet valve members and a plurality of simultaneously operated outlet poppet valve members, each of said inlet and outlet poppet valve members having a valve stem and being slidably mounted for reciprocating movement between its open and closed positions along an axis passing longitudinally through its valve stem, the axes of the valve stems of said inlet poppet valve members not all being parallel with each other; an inlet valve rocker member mounted for rocking movement about a rocking axis transverse to the axes of the inlet poppet valve member stems, said inlet valve rocker member having a tappet element for each inlet poppet valve member for engaging an end face of the respective valve stem of said inlet poppet valve members, the angular spacing between axial planes passing through the rocker axis and the points of engagement of the tappet elements with the end faces of the respective valve stems of the inlet poppet valve members corresponding to the angle between the axes of the respective valve stems of said inlet poppet valve members, the length of the valve stems of said inlet poppet valve members being such that the tappet elements of the inlet valve rocker member engage the valve stems of said inlet poppet valve member simultaneously, and said valve stems of said inlet poppet valve members being positioned such that at an intermediate position during the reciprocating movement of said inlet poppet valve members, lines from the inlet valve rocker member axis to the points of engagement of the tappet elements with the end face of the respective inlet poppet valve member stems are simultaneously perpendicular to the axes of the valve stems of the respective inlet poppet valve members.

5. A poppet valve assembly according to claim 1, wherein the valve stem axes are equidistant from the rocker axis.

6. A poppet valve assembly according to claim 2, wherein a tappet pad for each valve is articulated to the rocker and has an abutment face for slidably engaging the end face of the associated valve member, and the angular spacing of the centre of articulation of the tappet pads relative to the rocker axis corresponds to the angles between the axes of the respective valve stems.

7. A poppet valve assembly according to claim 6, wherein for each of said valves, a line through the rocker axis and the centre of said articulation is at right angles to the axis of the valve member in an intermediate point in the valve lifting movement of the rocker.

8. A poppet valve assembly according to claim 7, wherein the valve stem axes are equidistant from the rocker axis.

9. A poppet valve assembly according to claim 3, wherein an outlet valve rocker member operates said plurality of outlet poppet valve members.

10. A poppet valve assembly according to claim 9, wherein there are three inlet poppet valve members and at least two outlet poppet valve members.

11. A poppet valve assembly according to claim 10, wherein a single cam shaft operates said inlet and outlet poppet valve members.

12. A poppet valve assembly according to claim 4, wherein an outlet valve rocker member operates said plurality of outlet poppet valve members.

13. A poppet valve assembly according to claim 12, wherein there are three inlet poppet valve members and at least two outlet poppet valve members.

14. A poppet valve assembly according to claim 13, wherein a single cam shaft operates said inlet and outlet poppet valve members.

* * * * *

UNITED STATES PATENT AND TRADEMARK OFFICE

CERTIFICATE OF CORRECTION

PATENT NO. : 4 819 591

DATED : April 11, 1989

INVENTOR(S) : Ronald E. VALENTINE

It is certified that error appears in the above-identified patent and that said Letters Patent is hereby corrected as shown below:

Column 6, line 12; change "element" to ---elements---.

Column 6, line 18; change "point" to ---points---.

Column 6, line 20; before "simultaneously" insert ---are---.

Column 6, line 53; change "face" to ---faces---.

Signed and Sealed this

Thirteenth Day of February, 1990

*Attest:*

JEFFREY M. SAMUELS

*Attesting Officer*

*Acting Commissioner of Patents and Trademarks*